343-756
8/23/83 XR 4,400,701 SR

United States Patent [19]
Dupressoir

[11] 4,400,701
[45] Aug. 23, 1983

[54] COMMON ANTENNA FOR PRIMARY AND SECONDARY RADAR

[75] Inventor: Albert Dupressoir, Paris, France

[73] Assignee: Thomson-CSF, Paris, France

[21] Appl. No.: 227,770

[22] Filed: Jan. 23, 1981

[30] Foreign Application Priority Data

Jan. 28, 1980 [FR] France ..... 80 01760

[51] Int. Cl.[3] ..... H01Q 15/22
[52] U.S. Cl. ..... 343/725; 343/756; 343/840
[58] Field of Search ..... 343/725, 840, 756, 895

[56] References Cited

U.S. PATENT DOCUMENTS 2,895,127 7/1959 Padgett ..... 343/840
3,445,850 5/1969 Stegen ..... 343/840
3,550,135 12/1970 Bodmer ..... 343/840

FOREIGN PATENT DOCUMENTS 1094892 5/1955 France .
1540954 8/1968 France .

*Primary Examiner*—Eli Lieberman
*Attorney, Agent, or Firm*—Karl F. Ross

[57] ABSTRACT

A bifunctional antenna of a primary/secondary radar system comprises a reflector having a concave front surface illuminated by a source of primary radiation and formed with a row of circular ports along a horizontal generatrix, the ports lying forwardly of respective cavities or waveguides of cylindrical configuration excitable to emit circularly polarized secondary radiation. In some embodiments the polarization may be changed to a linear or an elliptical mode under the control of inserts rotatable about the cavity axis.

11 Claims, 4 Drawing Figures

COMMON ANTENNA FOR PRIMARY AND SECONDARY RADAR

CROSS-REFERENCE TO RELATED APPLICATION

This application contains subject matter first disclosed in my copending application Ser. No. 105,733 filed Dec. 20, 1979, now U.S. Pat. No. 4,284,991.

FIELD AND BACKGROUND OF THE INVENTION

My present invention relates to a common antenna for primary and secondary radar systems.

Generally, when the antenna of the secondary radar is integrated with the antenna of the primary radar, thus forming a combined primary/secondary antenna structure, this bifunctional antenna comprises a single reflector illuminated by an associated source in such a way as to be capable of radiating outgoing energy into space for the purpose of detecting a target such as an aircraft, this being called the primary radar function, and also of emitting an interrogation signal in the direction of this aircraft which is assumed to be equipped with an onboard automatic responder termed a transponder, this being called the secondary radar function.

The radiated beam conveying the interrogation signal is effective in the direction where the aircraft has been detected; however, it has been noticed that the transponder of the interrogated aircraft could be triggered by the secondary lobes of the interrogation pattern whose level is liable to be relatively high with respect to that of the principal lobe. To remedy this disadvantage, as noted in my above-identified prior patent, the single antenna here considered can be provided with supplemental radiating elements affecting the reception of the interrogation signal by the remote transponder as well as the reception of the response from the latter by the local receiver; these elements radiate in a substantially omnidirectional control pattern whose level is such as to blank the secondary lobes of the interrogation pattern.

By means of a comparison in the associated circuits of the amplitude of the pulses received from the transponder with those received from the control system, this arrangement facilitates a detection of the pulse received in response to the interrogation by the principal lobe. The means for establishing the control pattern must be such that the gain of the associated control channel is greater than that of the interrogation and reception channel in the angular zones comprising secondary lobes of the directional interrogation pattern but much smaller in the direction of the principal lobe.

According to the disclosure of my above-identified copending application and patent, the secondary radar function is performed by a row of linear radiating elements or transceivers, totally integrated in the reflector of the antenna, along a generatrix intersecting the boresight axis of the antenna by passing through the projection of its phase center onto the concave reflector surface. In that system the emission-reception source of the primary radar function radiates a wave which is polarized rectilinearly and orthogonally to the rectilinearly polarized wave emitted by the radiating elements of the secondary radar function.

OBJECT OF THE INVENTION

The object of my present invention is to extend the principle of integration of a radiating network in the reflector of the antenna to other types of radiating sources, particularly those emitting circularly or elliptically polarized waves.

SUMMARY OF THE INVENTION

In accordance with my present invention I provide a common antenna for a primary and secondary radar, of the type disclosed in my prior patent, comprising on the one hand a single reflector illuminated by an emission-reception source for the primary radar function and, on the other hand, a row of radiation emitters disposed—as in my prior system—entirely within the body of the reflector along a generatrix passing through the projection of the phase center of the antenna. Whereas, however, the radiation emitters of that prior system comprise linear exciters inside prismatic cavities terminating in rectangular slots on the reflector surface, the cavities of my present antenna are cylindrical and terminate in coaxial circular ports. Advantageously, pursuant to a more particular feature of my invention, each cavity includes polarizing means rotatable about its axis and interposed between the respective exciter and the concave reflector surface, e.g. within the circular port itself, to enable the selective generation of rectilinearly, circularly or elliptically polarized waves.

BRIEF DESCRIPTION OF THE DRAWING

The above and other features of my present invention will now be described in detail with reference to the accompanying drawing in which.

SPECIFIC DESCRIPTION

As was mentioned above, a common antenna for primary and secondary radars may require different modes of polarization of the waves emitted by its several sources. Thus, if the source of primary radiation emits rectilinearly polarized waves, the sources of secondary radiation may emit a wave which is rectilinearly polarized and orthogonal to the first one, as in the system of my prior patent, or else a circularly or elliptically polarized wave, provided that these primary and secondary sources do not absorb each other's waves. Similarly, when the source of primary radiation emits a circularly or elliptically polarized wave, the sources of secondary radiation may emit a counterrotating polarized wave.

In case the secondary radar function provides a control channel as described above, the latter may emit polarized waves different from those emitted by the primary source or even by the secondary sources. Various wave-control means for establishing the desired mode of polarization for the emitted secondary radiation will now be described.

Figure 1:
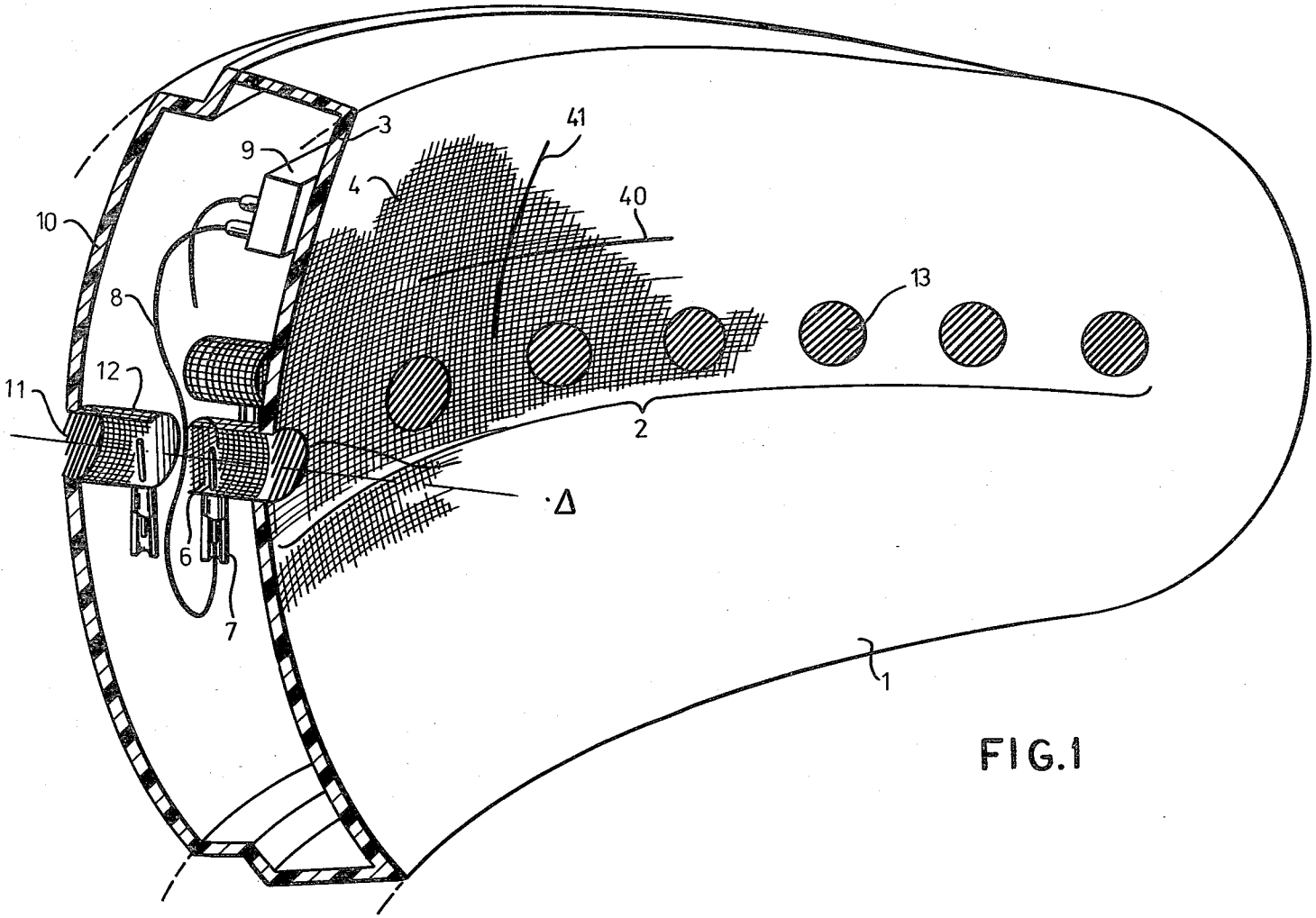
FIG. 1 is a perspective sectional view of a common antenna reflector for primary and secondary radars in accordance with my invention, comprising a row of radiating elements with exciters radially disposed in cylindrical waveguides provided with rotatable polarizing means.

FIG. 1 shows schematically a sectional view of a common antenna reflector 1 for primary and secondary radars, comprising an array 2 of radiating elements for the selective generation of rectilinearly, circularly or elliptically polarized waves.

Reflector 1 is formed from a metallic or dielectric material 3, e.g. from an epoxy-impregnated glass mat covered with a tissue 4 of glass fibers carrying crossed, covered metal wires 40 and 41. These wires are generally made from copper strands of small thickness.

The radiating elements of FIG. 1 each comprise a vertical exciter 6 radially disposed in a cylindrical waveguide generally designated 2*i*, with i ranging from 1 to n where n represents the total number of elements in the group. A polarizing device 13 for the wave emitted by each radiator 2, 6 is rotatable about the longitudinal axis Δ of each guide, extending radially to the reflector surface, and is situated in a circular aperture of that surface. This polarizing device 13 is formed by a planar grid of parallel metal blades or by several juxtaposed sets of parallel metal wires. Such a grouping of wires enables better impedance matching, and the spacing as well as the number of these juxtaposed sets can be varied to allow adjustment of the width of the operating band of the radiation emitters 2, 6. In order to make the polarizing devices 13 equivalent to a part of the reflector 1 with regard to the polarized wave emitted by the source of primary radiation confronting that reflector, the dimensions of each waveguide must be such as to establish a short-circuit plane at the front face of reflector 1.

The wavelengths 2*i* are formed in reflector 1 from the same material as the reflector itself and are covered in the same way with a tissue 4 of glass fibers carrying peripherally and axially extending metal wires.

To reduce the volume of waveguides 2*i* and to form a monolithic unit simple to construct, the guides are filled with dielectric 3. The exciting elements 6 for these guides 2*i*, which can be of the plunger or the crossbar type, are inserted into the dielectric 3 filling the guides and have each a coaxial base 7 allowing impedance matching between the guides 2*i* and associated coaxial lines 8 which connect them to a power divider 9, placed at the back of the reflector 1 and identical with that described in my prior patent.

When use is made of a control channel whose pattern, given by the radiation emitters 2, 6 opening onto the front face of reflector 1, does not ensure proper blanking of the rear part of the directional pattern or diagram of the interrogation channel, this control channel is provided with one or more additional, rearwardly radiating elements such as waveguides 11 formed in the material of a cap or cover 10. These additional radiation sources 11 are similar to and axially aligned with some of the forwardly radiating elements.

Figure 2:
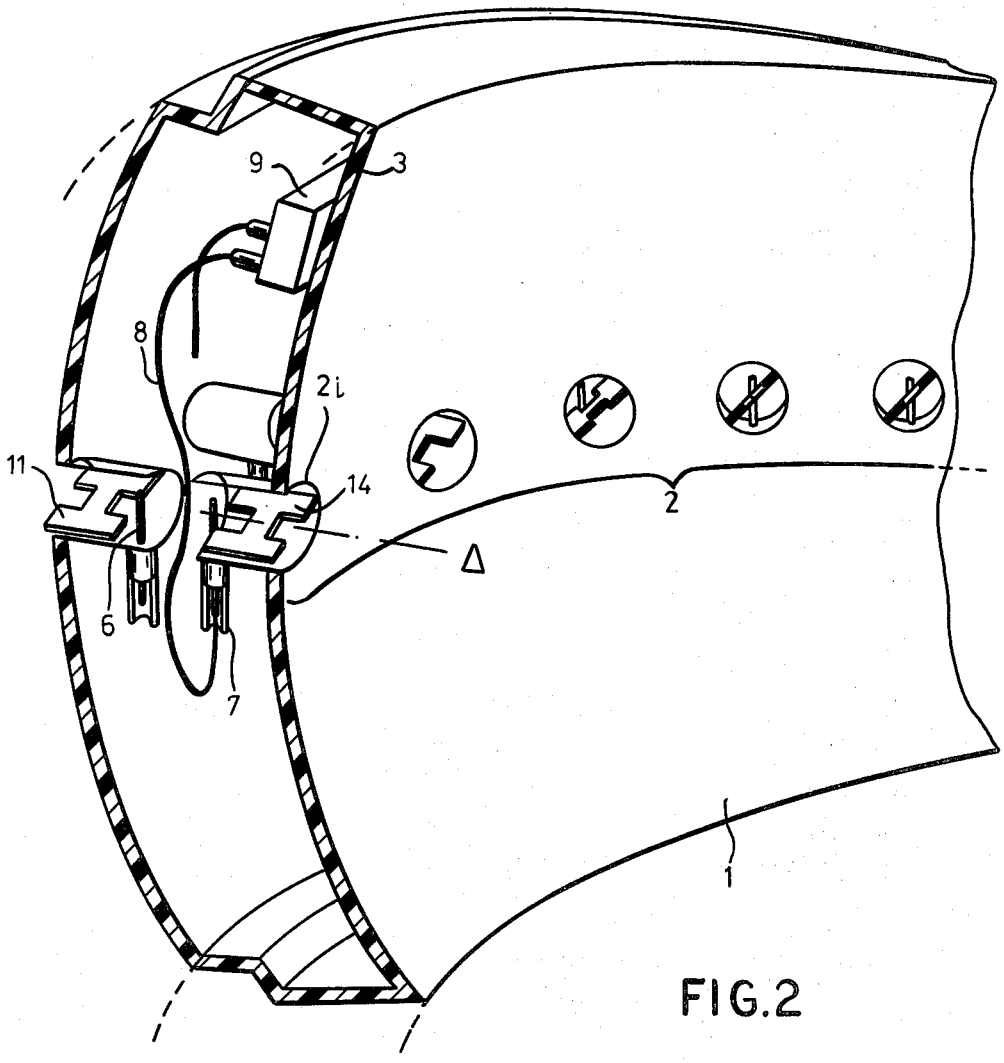
FIG. 2 is a similar view of another reflector with modified polarizing means.

FIG. 2 shows another embodiment of my invention having radiating elements adjustable to emit rectilinearly, circularly or elliptically polarized waves. Here, the polarizing devices of waveguides 2*i* are inserts 14 in the form of generally H-shaped dielectric plates. Each insert 14 is symmetrical with respect to the longitudinal axis Δ of the respective guide 2*i* and rotatable about this axis Δ so as to vary the angle of inclination of its plane relative to the associated exciter 6, depending on the channel whose radiation is to be controlled. Thus, a directional channel of the secondary radar may emit circularly polarized waves through a certain number of the elements 2*i* of row 2 whose polarizing devices 14 have been correspondingly oriented.

Alternatively, such a polarizing device may be formed by adjustable iris diaphragms allowing the aperture of the guide to be modified according to the desired mode of polarization.

If no change in the mode of polarization is required, I may provide the secondary-radiation emitters with fixed means for generating circularly or elliptically polarized waves, to the exclusion of each other. Such means may comprise an excitation element coiled in each cavity about the axis thereof.

Figure 3:
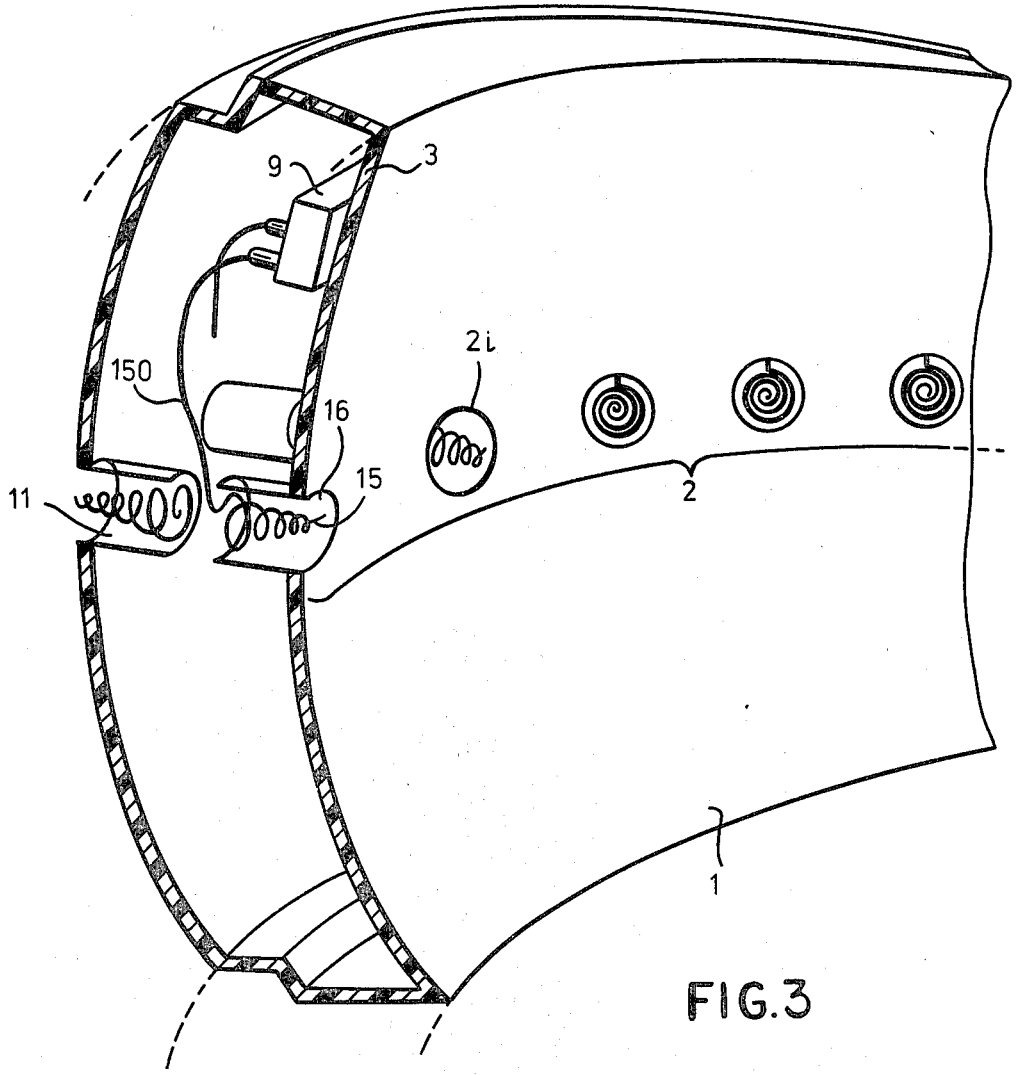
FIG. 3 similarly shows part of a further reflector in accordance with my invention, comprising waveguides with radiating helices.
Figure 4:
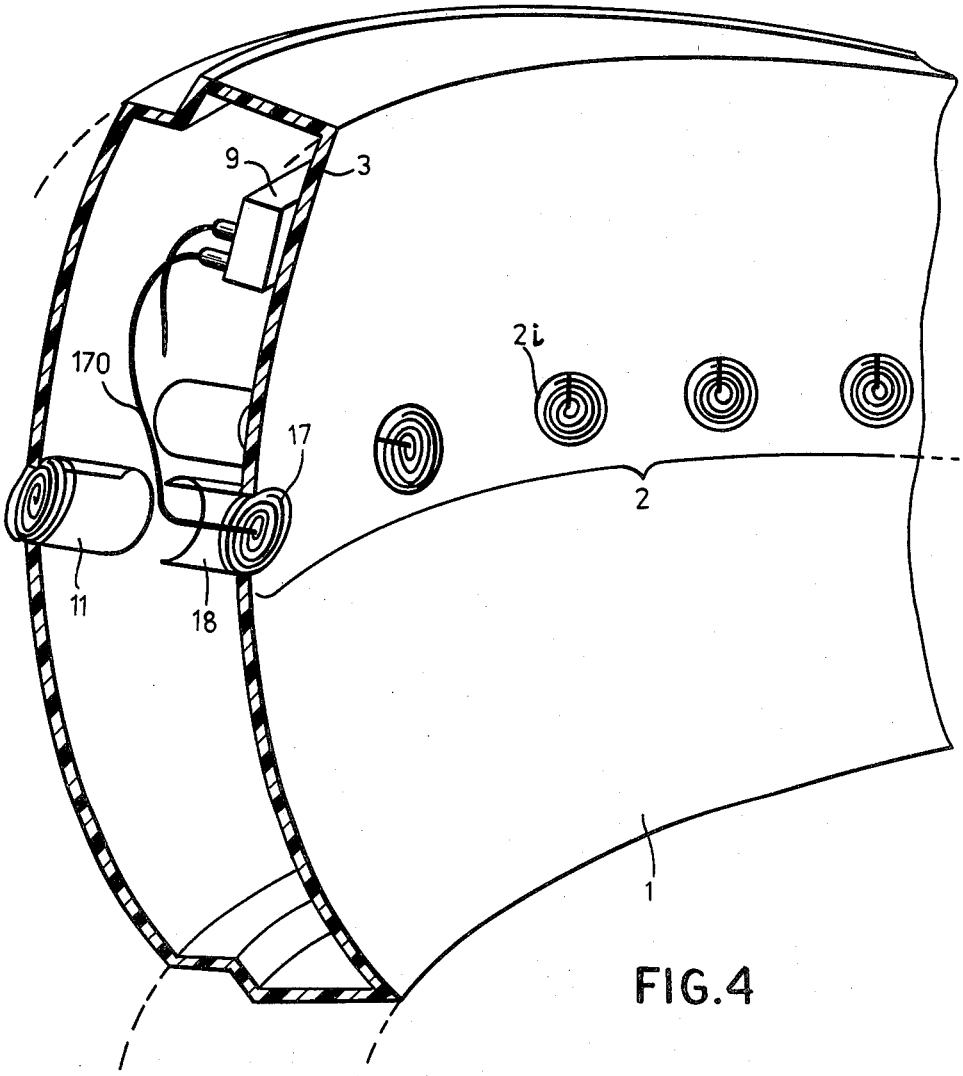
FIG. 4 is again a perspective sectional view of a reflector according to my invention, comprising waveguides with radiating spirals.

In FIG. 3, the radiation-generating elements are formed by helices 15 each placed in a cylindrical waveguide or cavity 16, similar to those of the preceding Figures, whose dimensions are again such as to establish a short-circuit plane at the front face of reflector 1. Each helix is connected to the power divider 9 by a coaxial line 150 and tapers toward the front aperture or port of its cavity. In FIG. 4, the radiating elements are spirals 17 placed in the circular apertures of the front wall of the reflector and are each excited by a resonant cavity 18 integrated in this same reflector dimensioned, as in the foregoing instance, to establish a short-circuit plane at the front face of the reflector. These spirals are formed mechanically or are deposited by photogravure on a dielectric wafer. The operating energy for each spiral is supplied through a coaxial line 170 which connects it to the power divider 9.

In these two latter embodiments it is possible, as in the preceding cases, to place a few radiating elements in the rear cover so as to let the pattern of the control channel blank the rear secondary lobes of the radiating pattern of the interrogation channel of the secondary radar.

What is claimed is:

1. A bifunctional antenna for a primary/secondary radar system, comprising:

a reflector formed of a body of dielectric material with a reflective surface of crossed wires, said reflector being adapted to be illuminated by a primary source of outgoing radiation for detecting a remote target;

a row of emitters of secondary radiation disposed along a generatrix of said front surface intersecting a boresight axis, said emitters being formed by circular ports in said front surface backed by cylindrical cavities having walls integral with said body, said cavities being coaxial with said ports and having axes extending in radial directions of said front surface; and wave-control means in said cavities adapted to establish a circular mode of polarization for the secondary radiation emitted thereby.

2. An antenna as defined in claim 1 wherein said wave-control means comprises an insert in each cavity rotatable about said axis thereof for selectively changing said circular mode of polarization to a different mode.

3. An antenna as defined in claim 2 wherein said emitters each include a linear exciter extending radially into said cavity at a location set back from said port thereof, said insert being located between said exciter and said front surface.

4. An antenna as defined in claim 3 wherein said insert is disposed within said port.

5. An antenna as defined in claim 3 wherein said insert comprises a planar grid of parallel conductors.

6. An antenna as defined in claim 3 wherein said insert is a flat dielectric plate centered on said axis.

7. An antenna as defined in claim 6 wherein said plate is substantially H-shaped.

8. An antenna as defined in claim 1 wherein said wave-control means comprises an excitation element in each cavity coiled about the axis thereof.

9. An antenna as defined in claim 8 wherein said excitation element is a helix tapering toward said port.

10. An antenna as defined in claim 8 wherein said excitation element is a spiral located in said port at the front of each cavity.

11. An antenna as defined in claim 1 wherein said cavities are dimensioned to establish a short-circuit plane at said front surface.

* * * * *